US008733081B2

(12) United States Patent
Miyashita

(10) Patent No.: US 8,733,081 B2
(45) Date of Patent: May 27, 2014

(54) CONTROL APPARATUS FOR INTERNAL COMBUSTION ENGINE

(75) Inventor: Shigeki Miyashita, Susono (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 819 days.

(21) Appl. No.: 13/001,706

(22) PCT Filed: Apr. 12, 2010

(86) PCT No.: PCT/JP2010/056545

§ 371 (c)(1),
(2), (4) Date: Dec. 28, 2010

(87) PCT Pub. No.: WO2011/128967

PCT Pub. Date: Oct. 20, 2011

(65) Prior Publication Data

US 2011/0289904 A1 Dec. 1, 2011

(51) Int. Cl.

| | |
|---|---|
| ***F01N 3/00*** | (2006.01) |
| ***F02M 25/06*** | (2006.01) |
| ***F01N 3/10*** | (2006.01) |
| ***F02B 47/08*** | (2006.01) |

(52) U.S. Cl.

USPC ..... 60/278; 60/275; 60/285; 60/286; 60/299; 123/568.11; 123/568.18

(58) Field of Classification Search

USPC ..... 60/278, 285, 286, 299, 275

See application file for complete search history.

(56) References Cited

U.S. PATENT DOCUMENTS

| | | | | |
|---|---|---|---|---|
| 3,776,207 | A * | 12/1973 | Simko | 60/278 |
| 4,198,940 | A * | 4/1980 | Ishida | 123/568.2 |
| 5,517,976 | A * | 5/1996 | Bachle et al. | 123/568.11 |

(Continued)

FOREIGN PATENT DOCUMENTS

| | | | |
|---|---|---|---|
| JP | 05280433 | A * | 10/1993 |
| JP | 2003-003879 | A | 1/2003 |

(Continued)

OTHER PUBLICATIONS

English Translation of Otsuka, Iku; JP 05280433 A.*

*Primary Examiner* — Thomas Denion
*Assistant Examiner* — Anthony Ayala Delgado
(74) *Attorney, Agent, or Firm* — Kenyon & Kenyon LLP

(57) ABSTRACT

An object of the present invention is that after return from fuel cut, an oxygen storage amount in a catalyst in an exhaust path and an oxygen storage amount in a catalyst in an exhaust gas recirculating path are promptly adjusted to be in appropriate states, respectively. A control apparatus for an internal combustion engine of the present invention controls the internal combustion engine including a recirculating gas generating cylinder and a recirculating gas nongenerating cylinder. The control apparatus includes: an exhaust gas recirculating path for connecting the exhaust path through which exhaust gas only in the recirculating gas generating cylinder is delivered and an intake system; a recirculating catalyst provided on the exhaust gas recirculating path; and rich control means that performs rich control for controlling an air-fuel ratio to be temporarily richer than a theoretical air-fuel ratio when fuel injection is restarted after return from the fuel cut. The rich control means includes air-fuel ratio control means that controls an air-fuel ratio in the recirculating gas generating cylinder to be richer than an air-fuel ratio in the recirculating gas nongenerating cylinder when the rich control and an exhaust gas recirculation by the exhaust gas recirculating path are simultaneously performed.

5 Claims, 4 Drawing Sheets

(56) References Cited

U.S. PATENT DOCUMENTS

| | | | | |
|---|---|---|---|---|
| 5,894,726 | A * | 4/1999 | Monnier | 60/274 |
| 6,286,489 | B1 * | 9/2001 | Bailey | 123/568.11 |
| 6,367,245 | B1 * | 4/2002 | Yasui et al. | 60/277 |
| 6,634,345 | B2 * | 10/2003 | Yoshizaki et al. | 123/568.12 |
| 7,299,625 | B2 * | 11/2007 | Uchida et al. | 60/277 |
| 7,464,540 | B2 * | 12/2008 | Easley et al. | 60/285 |
| 8,171,918 | B2 * | 5/2012 | Okada et al. | 123/568.12 |
| 2002/0165063 | A1 * | 11/2002 | Ito | 477/37 |
| 2011/0219750 | A1 * | 9/2011 | Sakurai et al. | 60/285 |

FOREIGN PATENT DOCUMENTS

| | | | |
|---|---|---|---|
| JP | 2004-150341 | A | 5/2004 |
| JP | 2005-256666 | A | 9/2005 |
| JP | 2006-090264 | A | 4/2006 |
| JP | 2007-009779 | A | 1/2007 |
| JP | 2008-274872 | A | 11/2008 |

* cited by examiner

CONTROL APPARATUS FOR INTERNAL COMBUSTION ENGINE

This is a 371 national phase application of PCT/JP2010/056545 filed 12 Apr. 2010, the content of which is incorporated herein by reference.

TECHNICAL FIELD

The present invention relates to a control apparatus for an internal combustion engine.

BACKGROUND ART

There has been widely known an internal combustion engine including an EGR path that connects an exhaust path and an intake path of the internal combustion engine for enabling exhaust gas recirculation (EGR) that recirculates a part of exhaust gas into the intake path via the EGR path (for example, see Patent Literature 1).

CITATION LIST

Patent Literature

Patent Literature 1: JP-A-2003-3879
Patent Literature 2: JP-A-2007-9779

SUMMARY OF INVENTION

Technical Problem

When EGR is employed, deposits are easily accumulated in an EGR path, an EGR cooler, an intake port, an intake valve or the like. The deposits are accumulated partly because recirculating exhaust gas (EGR gas) contains unburned HC, NOx, PM and the like. Therefore, in order to suppress the accumulation of the deposits, a technique in which a catalyst for purifying the exhaust gas (EGR catalyst) is provided on the EGR path to purify the unburned HC, NOx, PM and the like contained in the EGR gas has been suggested.

Note that, fuel cut is usually executed during deceleration of an internal combustion engine. During the fuel cut, fresh air that does not contain fuel is delivered to an exhaust gas purifying catalyst provided on an exhaust path. Accordingly, when the fuel cut is executed, the exhaust gas purifying catalyst fully stores oxygen and an oxygen storage amount becomes excessive.

In order to fully exert the purification ability of the exhaust gas purifying catalyst (three-way catalyst), it is necessary that its oxygen storage amount be about half of its maximum oxygen storage amount. Therefore, there has been known a technique to perform rich control so that an air-fuel ratio is temporarily richer than a theoretical air-fuel ratio to adjust the oxygen storage amount in the exhaust gas purifying catalyst to become a half of the maximum oxygen storage amount after fuel injection is restarted following return from the fuel cut.

Meanwhile, oxygen is also excessively stored in the EGR catalyst when the fuel cut is executed. Fresh air in the exhaust path goes in and out of the EGR path by pulsation generated in the exhaust path even when the EGR valve of the EGR path is closed during the fuel cut, and therefore oxygen is gradually stored in the EGR catalyst. Alternatively, the EGR valve may be operated to confirm the operation of the EGR valve during the fuel cut for detecting the change of pressure in an intake pipe. In such an instance, oxygen is stored in the EGR catalyst at once because fresh air is delivered into the EGR path. In either instance, oxygen is excessively stored in the EGR catalyst because of the fuel cut. Thus, after return from the fuel cut, it is desirable that the EGR catalyst be promptly adjusted so that its oxygen storage amount is a half of its maximum oxygen storage amount.

The present invention is made in view of the above-described circumstances, and an object thereof is to provide a control apparatus for an internal combustion engine capable of promptly adjusting an oxygen storage amount in a catalyst in an exhaust path and an oxygen storage amount in a catalyst in an exhaust gas recirculating path to be in appropriate states respectively after return from fuel cut.

Solution to Problem

First aspect of the present invention is a control apparatus for an internal combustion engine, comprising:

an internal combustion engine including at least one recirculating gas generating cylinder capable of recirculating a part of its exhaust gas to an intake system and at least one recirculating gas nongenerating cylinder that does not recirculate its exhaust gas to the intake system;

an exhaust gas recirculating path having one end connected to an exhaust path through which exhaust gas only from the recirculating gas generating cylinder flows and having the other end connected to the intake system;

an exhaust catalyst for purifying exhaust gas provided on an exhaust path through which exhaust gas from the recirculating gas generating cylinder and the recirculating gas nongenerating cylinder flows;

a recirculating catalyst provided on the exhaust gas recirculating path for purifying exhaust gas that recirculates to the intake system;

fuel cut means that executes fuel cut for temporarily stopping fuel injection of the internal combustion engine; and rich control means that performs rich control for controlling an air-fuel ratio of the internal combustion engine to be temporarily richer than a theoretical air-fuel ratio when the fuel injection is restarted after return from the fuel cut, wherein the rich control means includes air-fuel ratio control means that controls an air-fuel ratio in the recirculating gas generating cylinder to be richer than an air-fuel ratio in the recirculating gas nongenerating cylinder when the rich control and an exhaust gas recirculation by the exhaust gas recirculating path are simultaneously performed.

Second aspect of the present invention is the control apparatus for an internal combustion engine according to the first aspect, wherein the air-fuel ratio control means controls the air-fuel ratio in the recirculating gas generating cylinder to be richer when an exhaust gas recirculation rate is low as compared to when the exhaust gas recirculation rate is high.

Third aspect of the present invention is the control apparatus for an internal combustion engine according to the first or the second aspect, wherein the air-fuel ratio control means controls the air-fuel ratio in each of the recirculating gas generating cylinder and the recirculating gas nongenerating cylinder so that an adjustment of an oxygen storage amount in the recirculating catalyst is completed simultaneously with or before completion of an adjustment of an oxygen storage amount in the exhaust catalyst.

Fourth aspect of the present invention is the control apparatus for an internal combustion engine according to any one of the first to the third aspects, further comprising:

second air-fuel ratio control means that controls the air-fuel ratio in the recirculating gas generating cylinder to be the theoretical air-fuel ratio and controls the air-fuel ratio in the recirculating gas nongenerating cylinder to be richer than the theoretical air-fuel ratio when the adjustment of the oxygen storage amount in the recirculating catalyst is completed before the adjustment of the oxygen storage amount in the exhaust catalyst is completed.

Advantageous Effects of Invention

According to the first aspect of the present invention, an oxygen storage amount in an exhaust catalyst and an oxygen storage amount in a recirculating catalyst can be promptly adjusted to be in appropriate states respectively after return from fuel cut. Accordingly, the purification ability of each of the exhaust catalyst and the recirculating catalyst can be promptly restored after return from the fuel cut.

According to the second aspect of the present invention, the oxygen storage amount in the recirculating catalyst can be promptly adjusted even when an exhaust gas recirculation rate is low.

According to the third aspect of the present invention, problems (for example, deterioration of fuel economy, deterioration of drivability, degradation of the exhaust catalyst due to an unnecessary temperature increase, and deterioration of exhaust gas emission) caused when the adjustment of the oxygen storage amount in the recirculating catalyst is not completed before the adjustment of the oxygen storage amount in the exhaust catalyst is completed can be reliably avoided.

According to the forth aspect of the present invention, when the adjustment of the oxygen storage amount in the recirculating catalyst is completed before the adjustment of the oxygen storage amount in the exhaust catalyst is completed, the oxygen storage amount in the recirculating catalyst can be maintained in an appropriate state to continue the adjustment of the oxygen storage amount in the exhaust catalyst.

DESCRIPTION OF EMBODIMENTS

First Embodiment

Figure 1:
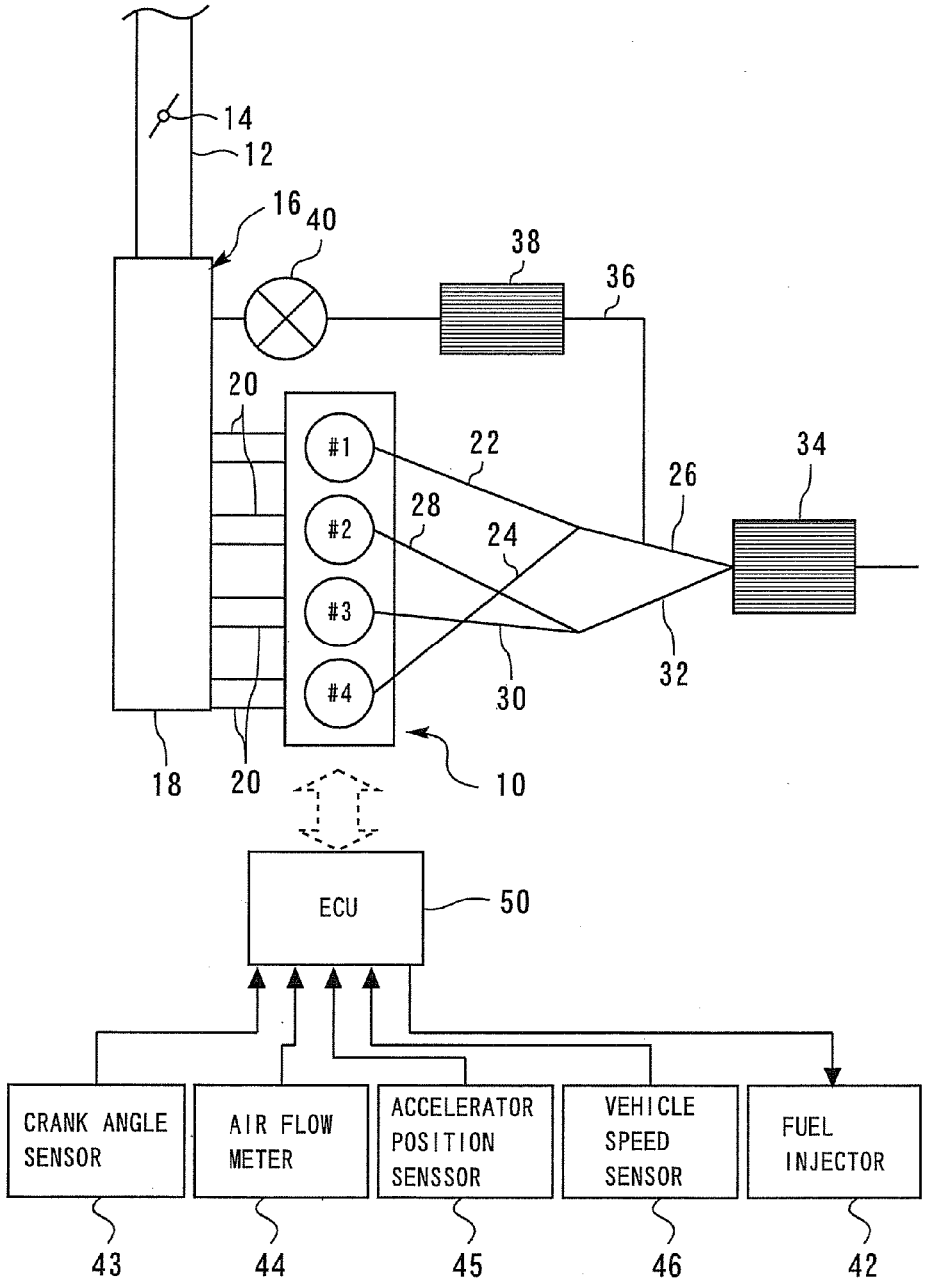
FIG. 1 shows a configuration of a system according to First Embodiment of the present invention.

FIG. 1 is an illustration for describing a configuration of a system according to a first embodiment of the present invention. As shown in FIG. 1, the system according to the first embodiment includes an internal combustion engine (hereinafter simply referred as an "engine") 10 mounted on a vehicle or the like. The engine 10 according to the embodiment is an inline four-cylinder engine including four cylinders of #1 to #4. An explosion order is an order of #1, #3, #4, and #2. Though not illustrated, a piston, an intake valve, an exhaust valve, an ignition plug, and a fuel injector 42 are provided on each cylinder.

A throttle valve 14 is provided on an intake path 12 that supplies intake air to the engine 10. The intake path 12 is connected to the engine 10 via an intake manifold 16. The intake manifold 16 includes a surge tank 18 and four intake branch pipes 20 projecting from the surge tank 18. Each intake branch pipe 20 is connected to an intake port of each cylinder.

An exhaust branch pipe 22 connected to an exhaust port of the #1 cylinder and an exhaust branch pipe 24 connected to an exhaust port of the #4 cylinder are connected to an exhaust path 26. An exhaust branch pipe 28 connected to an exhaust port of the #2 cylinder and an exhaust branch pipe 30 connected to an exhaust port of the #3 cylinder are connected to an exhaust path 32. An exhaust gas purifying catalyst 34 for purifying exhaust gas is provided on a lower stream of the exhaust path 26 and the exhaust path 32. The exhaust gas purifying catalyst 34 has a function as a three-way catalyst capable of storing and releasing oxygen.

Exhaust gas only from the #1 cylinder and #4 cylinder flows through the exhaust path 26. One end of an exhaust gas recirculating path (hereinafter referred to as an "EGR path") 36 is connected to the exhaust path 26. The other end of the EGR path 36 is connected to the surge tank 18. In this embodiment, exhaust gas recirculation (hereinafter referred to as "EGR") for recirculating a part of the exhaust gas from the #1 cylinder and #4 cylinder to an intake system through the EGR path 36 can be performed. The exhaust gas flowing in the EGR path 36 is hereinafter referred to as "EGR gas". The EGR gas delivered into the surge tank 18 from the EGR path 36 is mixed with fresh air and is delivered into the #1 to #4 cylinders. Note that the other end of the EGR path 36 may communicate with the intake path 12 between the throttle valve 14 and the surge tank 18, instead of the surge tank 18. Alternatively, the other end of the EGR path 36 may communicate with the intake branch pipe 20 of each cylinder.

An EGR catalyst 38 for purifying the EGR gas and an EGR valve 40 for adjusting a flow rate of the EGR gas (hereinafter referred to as an "EGR flow rate") are provided on the EGR path 36. The EGR catalyst 38 has a function as a three-way catalyst capable of storing and releasing oxygen.

During execution of EGR, a part of exhaust gas from the #1 cylinder and #4 cylinder is delivered through the EGR path 36 and recirculated to the intake system as the EGR gas, and the remaining part is delivered into the exhaust gas purifying catalyst 34 through the exhaust path 26. On the other hand, all of exhaust gas from the #2 cylinder and #3 cylinder is always delivered into the exhaust gas purifying catalyst 34.

In FIG. 1, the exhaust branch pipes 22, 24, 28, and 30, the exhaust paths 26 and 32, and the EGR path 36 are shown by lines for simplicity.

The system of the embodiment further includes: an ECU (Electronic Control Unit) 50 for controlling the operation of engine control actuators including the above-described throttle valve 14, the EGR valve 40, the fuel injector 42, and the ignition plug; and engine control sensors as follows. A crank angle sensor 43 outputs a signal synchronized with the rotation of a crank shaft of the engine 10. The ECU 50 can detect an engine rotational speed and a crank angle based on the output of the crank angle sensor 43. An air flow meter 44 detects an amount of fresh air sucked into the intake path 12. An accelerator position sensor 45 detects an operation amount of an accelerator pedal operated by a driver of a vehicle. A vehicle speed sensor 46 detects a speed of the vehicle.

The ECU 50 detects engine operating information by the above-described sensors, and controls the operation by driving the actuators based on the detected result. For example, the ECU 50 controls an air-fuel ratio by calculating a fuel injection amount necessary for realizing a target air-fuel ratio based on the engine rotational speed detected by the crank angle sensor 43 and the intake air amount detected by the air flow meter 44.

Also, the ECU 50 can calculate a current EGR rate (exhaust gas recirculation rate) based on information of the engine rotational speed, an engine load and the like, and an opening degree of the EGR valve 40 (hereinafter referred to as an "EGR valve opening degree"). The ECU 50 also calculates a target EGR rate based on an EGR map that defines a relation of the target EGR rate with the engine rotational speed and the engine load. Then, the ECU 50 performs EGR control for controlling the EGR valve opening degree to eliminate the deviation between the current EGR rate and the target EGR rate. Further, the ECU 50 performs fuel cut control as described just below and rich control as described later.

The system of this embodiment executes the fuel cut for stopping fuel injection from the fuel injector 42 of each cylinder when the engine rotational speed is a predetermined rotational speed or more and an output of the engine 10 is not required (for example, when a driver releases an accelerator pedal to slow down a vehicle).

When a predetermined return condition is satisfied (for example, when the accelerator pedal is depressed or when the engine rotational speed becomes a predetermined return rotational speed or less) during execution of the fuel cut, the fuel injection from the fuel injector 42 is restarted with return from the fuel cut.

Note that to fully exert the purification ability of the exhaust gas purifying catalyst 34, it is necessary that its oxygen storage amount be about half of its maximum oxygen storage amount (oxygen storage capacity). Similarly, to fully exert the purification ability of the EGR catalyst 38, it is necessary that its oxygen storage amount be about half of its maximum oxygen storage amount (oxygen storage capacity).

However, since fresh air is delivered to the exhaust gas purifying catalyst 34 during the fuel cut, the exhaust gas purifying catalyst 34 fully stores oxygen.

Also, the EGR catalyst 38 excessively stores oxygen during the fuel cut. As described above, even when the EGR valve 40 is closed during the fuel cut, fresh air in the exhaust path 26 goes in and out of the EGR path 36 by pulsation generated in the exhaust path 26 and therefore oxygen is gradually stored in the EGR catalyst 38. Alternatively, the EGR valve 40 may be operated to confirm the operation of the EGR valve 40 during the fuel cut for detecting the change of pressure in an intake pipe. In such an instance, oxygen is stored in the EGR catalyst 38 at once because fresh air is delivered into the EGR path 36.

At the time of return from the fuel cut, it is desirable that the oxygen storage amount of each of the exhaust gas purifying catalyst 34 and the EGR catalyst 38 return to a half of the maximum oxygen storage amount as soon as possible in order to fully exert the purification abilities thereof. Therefore, in this embodiment, a control for controlling an air-fuel ratio in exhaust gas to be temporarily richer than a theoretical air-fuel ratio (hereinafter referred to as "rich control") is performed so that the oxygen storage amount of each of the exhaust gas purifying catalyst 34 and the EGR catalyst 38 is adjusted to be a half of the maximum oxygen storage amount after return from the fuel cut. By performing the rich control, exhaust gas having a rich air-fuel ratio containing a large amount of reducing agent components such as unburned HC and CO is delivered to the exhaust gas purifying catalyst 34 and the EGR catalyst 38, so that the stored oxygen is consumed by reaction with the reducing agent. Thus, the oxygen storage amount can be reduced and adjusted to be the half of the maximum oxygen storage amount.

When the oxygen storage amounts in both the exhaust gas purifying catalyst 34 and the EGR catalyst 38 are adjusted by the rich control, it is desirable that the adjustment of the oxygen storage amount in the EGR catalyst 38 be completed before the adjustment of the oxygen storage amount in the exhaust gas purifying catalyst 34 is completed. This is because when the adjustment of the oxygen storage amount in the EGR catalyst 38 is not completed at the time of completion of the adjustment of the oxygen storage amount in the exhaust gas purifying catalyst 34, the following problems are raised.

When the adjustment of the oxygen storage amount in the EGR catalyst 38 is not completed at the time of completion of the adjustment of the oxygen storage amount in the exhaust gas purifying catalyst 34, it is necessary that an air-fuel ratio in exhaust gas delivered to the EGR catalyst 38 be maintained to be richer than the theoretical air-fuel ratio until the adjustment of the oxygen storage amount in the EGR catalyst 38 is completed. A part of the exhaust gas from the #1 cylinder and #4 cylinder is delivered to the EGR catalyst 38. In such an instance, it is necessary that an air-fuel ratio in the #1 cylinder and #4 cylinder be richer than the theoretical air-fuel ratio. On the other hand, the adjustment of the oxygen storage amount in the exhaust gas purifying catalyst 34 is completed to be the half of the maximum oxygen storage amount. In order to maintain such a state, it is needed to maintain an air-fuel ratio in exhaust gas delivered to the exhaust gas purifying catalyst 34 to be the theoretical air-fuel ratio. However, the remaining part of exhaust gas having a rich air-fuel ratio from the #1 cylinder and #4 cylinder, which is not delivered into the EGR path 36, is delivered to the exhaust gas purifying catalyst 34. Thus, to control the air-fuel ratio in the exhaust gas delivered to the exhaust gas purifying catalyst 34 to be the theoretical air-fuel ratio, it is necessary that an air-fuel ratio in the #2 cylinder and #3 cylinder be leaner than the theoretical air-fuel ratio.

For the above-described reason, when the adjustment of the oxygen storage amount in the EGR catalyst 38 is not completed at the time of completion of the adjustment of the oxygen storage amount in the exhaust gas purifying catalyst 34, it is necessary that the air-fuel ratio in the #1 cylinder and #4 cylinder be rich and the air-fuel ratio in the #2 cylinder and #3 cylinder be lean. However, such an operation state that cylinders having a rich air-fuel ratio and cylinders having a lean air-fuel ratio simultaneously exist causes problems such as deterioration of fuel economy or deterioration of drivability raised by torque fluctuation. Also, since exhaust gas of the rich air-fuel ratio and exhaust gas of the lean air-fuel ratio are simultaneously delivered to the exhaust gas purifying catalyst 34, unburned HC contained in the exhaust gas of the rich air-fuel ratio and oxygen contained in the exhaust gas of the lean air-fuel ratio undergo a combustion reaction in the exhaust gas purifying catalyst 34. Consequently, the temperature of the exhaust gas purifying catalyst 34 is unnecessarily increased, thereby leading to the problem of deterioration of the exhaust gas purifying catalyst 34.

To avoid the above-described problems, in the rich control, it is desirable that the adjustment of the oxygen storage amount in the EGR catalyst 38 be completed before the adjustment of the oxygen storage amount in the exhaust gas purifying catalyst 34 is completed. Accordingly, it is desirable that the air-fuel ratio in the exhaust gas delivered to the EGR catalyst 38 be richer so as to consume oxygen stored in the EGR catalyst 38 more quickly. Thus, in this embodiment, the air-fuel ratio in the #1 cylinder and #4 cylinder which supply exhaust gas to the EGR catalyst 38 is further richer than the air-fuel ratio in the #2 cylinder and #3 cylinder which do not supply exhaust gas to the EGR catalyst 38 by the rich control.

Figure 2:
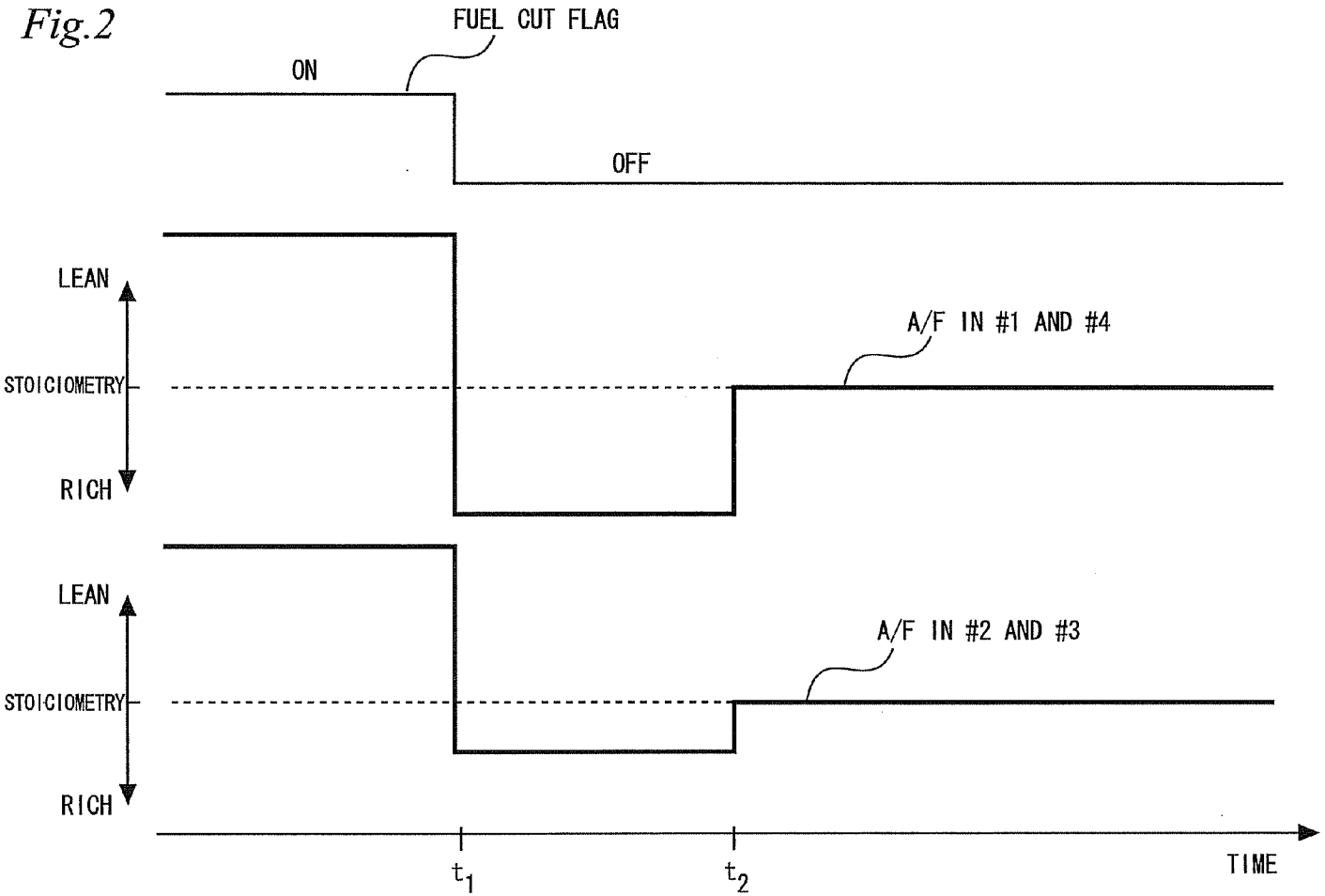
FIG. 2 is a time chart showing the change of an air-fuel ratio in #1 cylinder and #4 cylinder and the change of an air-fuel ratio in #2 cylinder and #3 cylinder after return from a fuel cut according to First Embodiment of the present invention.

FIG. 2 is a time chart showing the change of the air-fuel ratio in the #1 cylinder and #4 cylinder and the change of the air-fuel ratio in the #2 cylinder and #3 cylinder after return from the fuel cut. A fuel cut flag in FIG. 2 shows whether the fuel cut is executed or not. In the instance as shown in FIG. 2, the rich control is immediately started after the fuel injection is restarted with return from the fuel cut at the time $t_1$. In the embodiment, EGR is also performed immediately after return from the fuel cut.

As shown in FIG. 2, during execution of the rich control, the air-fuel ratio in each of the #1 to #4 cylinders is richer than the theoretical air-fuel ratio and the air-fuel ratio in the #1 cylinder and #4 cylinder is richer than the air-fuel ratio in the #2 cylinder and #3 cylinder.

In this embodiment, the amount of fuel injection in each cylinder is controlled as follows during execution of the rich control. In the following description, a rich amount in the #1 cylinder and #4 cylinder is referred to as $R_{\#1\#4}$, a rich amount in the #2 cylinder and #3 cylinder is referred to as $R_{\#2\#3}$, a target total rich amount in the EGR catalyst 38 is referred to as $R_{EGR}$, a target total rich amount in the exhaust gas purifying catalyst 34 is referred to as $R_{EXH}$, an EGR rate is referred to as $\alpha$, and a rich control cycle number is referred to as N. The rich amount $R_{\#1\#4}$ in the #1 cylinder and #4 cylinder and the rich amount $R_{\#2\#3}$ in the #2 cylinder and #3 cylinder are calculated by the following expressions.

$$R_{\#1\#4}=R_{EGR}/\alpha/N \quad (1)$$

$$R_{\#2\#3}=R_{EXH}/N-R_{\#1\#4}(1-\alpha) \quad (2)$$

The target total rich amount $R_{EGR}$ in the EGR catalyst 38 is set to have an oxygen amount corresponding to a half of the maximum oxygen storage amount (oxygen storage capacity) in the EGR catalyst 38. The EGR rate a shows a rate of exhaust gas recirculated to the intake system through the EGR path 36 out of a total exhaust gas amount. As described above, the ECU 50 calculates the EGR rate a based on the information of the engine rotational speed, the engine load and the like, and the EGR valve opening degree. During execution of EGR, the relationship $0<\alpha<1$ is satisfied. The rich control cycle number N preliminarily defines operation cycles of the engine 10 during execution of the rich control. For example, when the rich control is continued over 100 cycles of the engine 10, N is set to be equal to 100. The rich amount $R_{\#1\#4}$ in the #1 cylinder and #4 cylinder calculated by the above expression (1) represents an oxygen amount corresponding to an amount of reducing agent to be discharged from the #1 cylinder and #4 cylinder per one cycle.

During the rich control, the amount of the reducing agent corresponding to the rich amount $R_{\#1\#4}$ calculated by the above expression (1) is divided by the #1 cylinder and #4 cylinder to be supplied per each cycle. Therefore, in the #1 cylinder and #4 cylinder, a value calculated by adding to a basic fuel injection amount (a fuel injection amount necessary to have the theoretical air-fuel ratio) a fuel amount corresponding to a half of the rich amount $R_{\#1\#4}$ calculated by the above expression (1) is a total fuel injection amount. During execution of the rich control, the total fuel injection amount is injected from the fuel injector 42.

When the operation cycle number of the engine 10 from the start of the rich control is reached to N, a total amount of the reducing agent delivered to the EGR catalyst 38 is reached to an amount corresponding to the $R_{EGR}$. Thus at this point, the oxygen storage amount in the EGR catalyst 38 is reduced to a half of the Maximum oxygen storage amount, so that the adjustment of the oxygen storage amount in the EGR catalyst 38 is completed. Therefore, the ECU 50 determines that the adjustment of the oxygen storage amount in the EGR catalyst 38 is completed when the operation cycle number of the engine 10 from the start of the rich control is reached to N (at the time $t_2$ in FIG. 2), and controls the air-fuel ratio in the #1 cylinder and #4 cylinder to be returned to the theoretical air-fuel ratio. Subsequently, exhaust gas having the theoretical air-fuel ratio is delivered to the EGR catalyst 38, so that the oxygen storage amount in the EGR catalyst 38 is maintained to be the half of the maximum oxygen storage amount.

Note that according to the above expression (1), when the EGR rate a is low, the calculated rich amount $R_{\#1\#4}$ in the #1 cylinder and #4 cylinder is larger as compared to when the EGR rate $\alpha$ is high. Accordingly, when the EGR rate a is low, the air-fuel ratio in the #1 cylinder and #4 cylinder is richer as compared to when the EGR rate $\alpha$ is high. Thus, even when the EGR rate is low and the EGR flow rate is also low, the oxygen storage amount in the EGR catalyst 38 can be promptly adjusted.

The target total rich amount $R_{EXH}$ in the exhaust gas purifying catalyst 34 is set to have an oxygen amount corresponding to a half of the maximum oxygen storage amount (oxygen storage capacity) in the exhaust gas purifying catalyst 34. The rich amount $R_{\#2\#3}$ in the #2 cylinder and #3 cylinder calculated by the above expression (2) represents an oxygen amount corresponding to an amount of reducing agent to be discharged from the #2 cylinder and #3 cylinder per one cycle. In the embodiment, the adjustment of the oxygen storage amounts in both the exhaust gas purifying catalyst 34 and the EGR catalyst 38 is controlled to be simultaneously completed. Therefore, the rich control cycle number N in the #1 cylinder and #4 cylinder and the rich control cycle number N in the #2 cylinder and #3 cylinder are the same value.

When the reducing agent for adjusting the oxygen storage amount in the exhaust gas purifying catalyst 34 is discharged only from the #2 cylinder and #3 cylinder, the amount of the reducing agent to be discharged from the #2 cylinder and #3 cylinder per one cycle is $R_{EXH}/N$. However, the remaining part of exhaust gas which is not recirculated to the intake system is also delivered to the exhaust gas purifying catalyst 34 from the #1 cylinder and #4 cylinder. The amount of the reducing agent corresponding to $R_{\#1\#4}(1-\alpha)$ is delivered to the exhaust gas purifying catalyst 34 from the #1 cylinder and #4 cylinder. Therefore, the required rich amount $R_{\#2\#3}$ in the #2 cylinder and #3 cylinder is a value calculated by subtracting $R_{\#1\#4}(1-\alpha)$ from $R_{EXH}/N$. Thus, the above expression (2) is provided.

During execution of the rich control, the amount of the reducing agent corresponding to the rich amount $R_{\#2\#3}$ calculated by the above expression (2) is divided by the #2 cylinder and #3 cylinder to be supplied per each cycle. In the #2 cylinder and #3 cylinder, a value calculated by adding to the basic fuel injection amount a fuel amount corresponding to a half of the rich amount $R_{\#2\#3}$ calculated by the above expression (2) is a total fuel injection amount. The total fuel injection amount is injected from the fuel injector 42 during execution of the rich control.

When the operation cycle number of the engine 10 from the start of the rich control is reached to N, a total amount of the reducing agent delivered to the exhaust gas purifying catalyst 34 is reached to an amount corresponding to the above-described $R_{EXH}$. Thus at this point, the oxygen storage amount in the exhaust gas purifying catalyst 34 is reduced to a half of the maximum oxygen storage amount, so that the adjustment of the oxygen storage amount in the exhaust gas purifying catalyst 34 is completed. Therefore, the ECU 50 determines that the adjustment of the oxygen storage amount in the exhaust gas purifying catalyst 34 is completed when the operation cycle number of the engine 10 from the start of the rich control is reached to N (at the time $t_2$ in FIG. 2), and controls the air-fuel ratio in the #2 cylinder and #3 cylinder to be returned to the theoretical air-fuel ratio. As described above, the air-fuel ratio in the #1 cylinder and #4 cylinder is also back to the theoretical air-fuel ratio at this point. Thus, the exhaust gas having the theoretical air-fuel ratio is subsequently delivered to the exhaust gas purifying catalyst 34, so that the oxygen storage amount in the exhaust gas purifying catalyst 34 is maintained to be the half of the maximum oxygen storage amount.

As described above, in the rich control after return from the fuel cut according to this embodiment, the oxygen storage amounts in both the exhaust gas purifying catalyst 34 and the EGR catalyst 38 can be promptly adjusted by controlling the air-fuel ratio in the #1 cylinder and #4 cylinder which generate EGR gas to be further richer than the air-fuel ratio in the #2 cylinder and #3 cylinder which do not generate the EGR gas. Thus, the purification abilities of both the exhaust gas purifying catalyst 34 and the EGR catalyst 38 can be promptly restored after return from the fuel cut.

Specifically, in this embodiment, the adjustment of the oxygen storage amounts in the exhaust gas purifying catalyst 34 and the EGR catalyst 38 can be simultaneously completed by calculating the fuel injection amount in each cylinder by the above-described method. Therefore, the air-fuel ratio in each of the #1 to #4 cylinders can be returned to the theoretical air-fuel ratio simultaneously. Thus, according to the embodiment, the above-described problems caused when the adjustment of the oxygen storage amount in the EGR catalyst 38 is not completed at the time of completion of the adjustment of the oxygen storage amount in the exhaust gas purifying catalyst 34 can be reliably avoided.

In the above-described first embodiment, the #1 cylinder and the #4 cylinder correspond to the "recirculating gas generating cylinder" according to the first aspect of the present invention, the #2 cylinder and the #3 cylinder correspond to the "recirculating gas nongenerating cylinder" according to the first aspect of the present invention, the exhaust gas purifying catalyst 34 corresponds to the "exhaust catalyst" according to the first aspect of the present invention, and the EGR catalyst 38 corresponds to the "recirculating catalyst" according to the first aspect of the present invention. Also, the ECU 50 controls the fuel injection amount in each cylinder by the above-described method, thereby realizing "air-fuel ratio control means" according to the first, second, and third aspects of the present invention.

Although the present invention is described when being applied to an inline four-cylinder engine in the above-described first embodiment, the number of cylinders and the position of the cylinders according to the present invention are not limited thereto. The present invention is applicable to various types of engines having a plurality of cylinders. Also, the number of recirculating gas generating cylinders and the number of recirculating gas nongenerating cylinders are not particularly limited.

Second Embodiment

Next, a second embodiment according to the present invention will be described referring to FIG. 3. The difference from the above-described first embodiment will be mainly described, and the description of similar features will be simplified or omitted.

In the rich control according to the above-described first embodiment, the adjustment of the oxygen storage amounts in both of the exhaust gas purifying catalyst 34 and the EGR catalyst 38 is controlled to be simultaneously completed. On the other hand, according to the second embodiment, the adjustment of the oxygen storage amount in the EGR catalyst 38 is controlled to be completed before the adjustment of the oxygen storage amount in the exhaust gas purifying catalyst 34 is completed.

Figure 3:
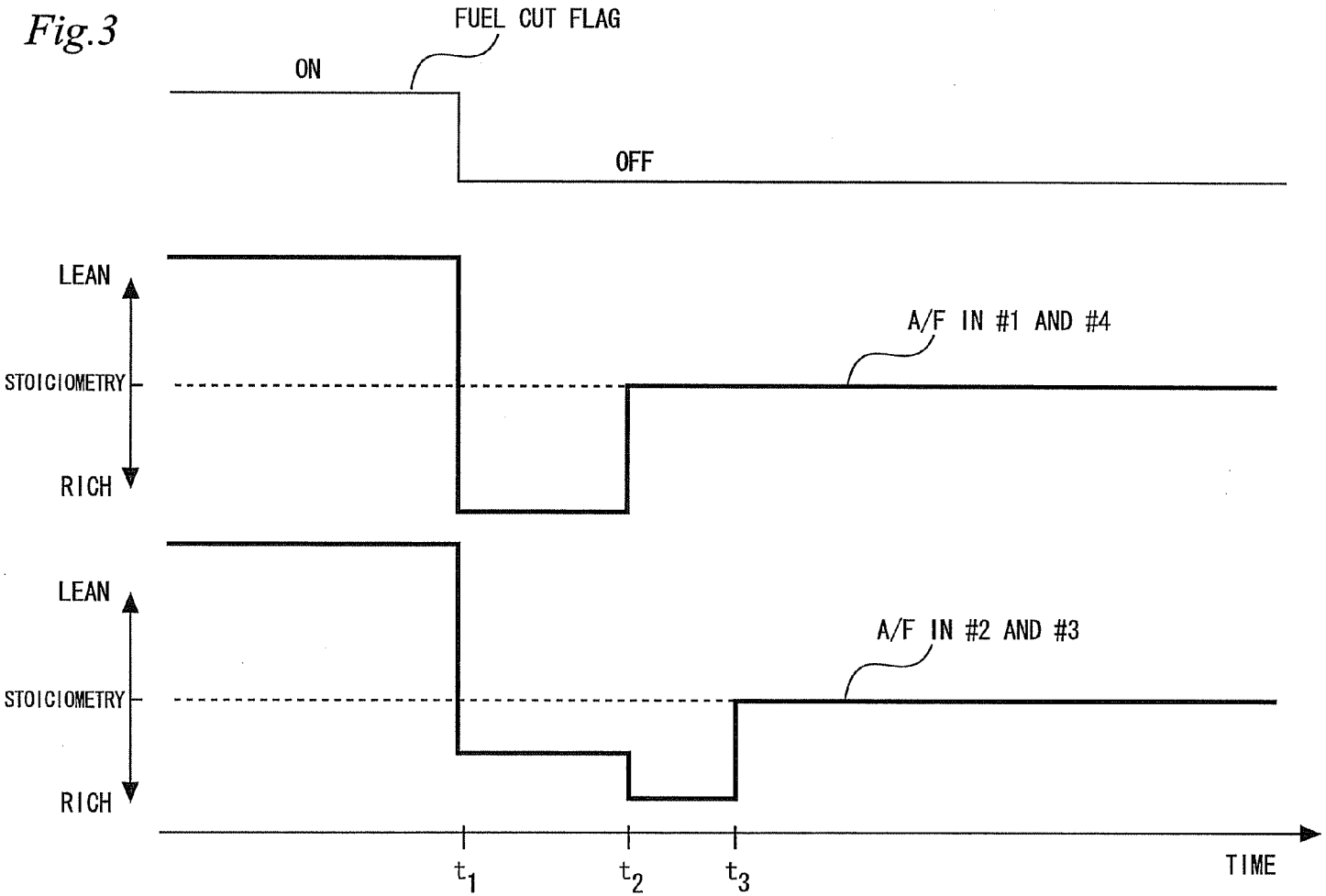
FIG. 3 is a time chart showing the change of an air-fuel ratio in #1 cylinder and #4 cylinder and the change of an air-fuel ratio in #2 cylinder and #3 cylinder after return from a fuel cut according to Second Embodiment of the present invention.

FIG. 3 is a time chart showing the change of an air-fuel ratio in the #1 cylinder and #4 cylinder and the change of an air-fuel ratio in the #2 cylinder and #3 cylinder after return from the fuel cut in this embodiment. In the instance as shown in FIG. 3, the rich control is immediately started when the fuel injection is restarted with return from the fuel cut at the time $t_1$. Also, in this embodiment, EGR is performed immediately after return from the fuel cut.

In the second embodiment, the rich amount $R_{1\#4}$ in the #1 cylinder and #4 cylinder and the rich amount $R_{\#2\#3}$ in the #2 cylinder and #3 cylinder are calculated by the following expressions. Here, $N_1$ denotes a rich control cycle number for the EGR catalyst 38 and $N_2$ denotes a rich control cycle number for the exhaust gas purifying catalyst 34. These are set in advance to satisfy the relationship $N_1<N_2$.

$$R_{\#1\#4}=R_{EGR}/\alpha/N_1 \tag{3}$$

$$R_{\#2\#3}=R_{EXH}/N_2-R_{\#1\#4}(1-\alpha) \tag{4}$$

In the #1 cylinder and #4 cylinder, a value calculated by adding to a basic fuel injection amount a fuel amount corresponding to a half of the rich amount $R_{\#1\#4}$ calculated by the above expression (3) is a total fuel injection amount. After the rich control is started at the time $t_1$ as shown in FIG. 3, the total fuel injection amount is injected from the fuel injector 42. When an operation cycle number of the engine 10 from the start of the rich control is reached to $N_1$ (at the time $t_2$ in FIG. 3), a total amount of reducing agent delivered to the EGR catalyst 38 is reached to an amount corresponding to the $R_{EGR}$. Thus at this point, it can be determined that the adjustment of the oxygen storage amount in the EGR catalyst 38 is completed. After this point (the time $t_2$ in FIG. 3), the relationship $R_{\#1\#4}=0$ is set. Therefore, the air-fuel ratio in the #1 cylinder and #4 cylinder is returned to the theoretical air-fuel ratio after the time $t_2$ as shown in FIG. 3. Since the exhaust gas having the theoretical air-fuel ratio is subsequently delivered to the EGR catalyst 38, the oxygen storage amount in the EGR catalyst 38 is maintained to be a half of the maximum oxygen storage amount.

On the other hand, in the #2 cylinder and #3 cylinder, a value calculated by adding to the basic injection amount a fuel amount corresponding to a half of the rich amount $R_{\#2\#3}$ calculated by the above expression (4) is a total fuel injection amount. After the rich control is started at the time $t_1$ as shown in FIG. 3, the total fuel injection amount is injected from the fuel injector 42. When the operation cycle number of the engine 10 from the start of the rich control is reached to $N_2$ (at the time $t_3$ in FIG. 3), a total amount of reducing agent delivered to the exhaust gas purifying catalyst 34 is reached to an amount corresponding to the $R_{EXH}$. Thus at this point, it can be determined that the adjustment of the oxygen storage amount in the exhaust gas purifying catalyst 34 is completed. After this point (the time $t_3$ in FIG. 3), the relationship $R_{\#2\#3}=0$ is set. Therefore, the air-fuel ratio in the #2 cylinder and #3 cylinder is returned to the theoretical air-fuel ratio after the time $t_3$ as shown in FIG. 3. Then, the exhaust gas having the theoretical air-fuel ratio is delivered to the exhaust gas purifying catalyst 34, so that the oxygen storage amount in the exhaust gas purifying catalyst 34 is maintained to be a half of the maximum oxygen storage amount.

Note that the relationship $R_{1\#4}=0$ is set between the time $t_2$ and time $t_3$ and therefore the rich amount $R_{\#2\#3}$ value calculated by the above expression (4) becomes larger as compared to a period between the time $t_1$ and time $t_2$. Thus, as shown in FIG. 3, the air-fuel ratio in the #2 cylinder and #3 cylinder is shifted in a rich direction at the time $t_2$.

As described above, in this embodiment, the adjustment of the oxygen storage amount in the EGR catalyst 38 can be completed at the time (the time $t_2$) before completion of the adjustment of the oxygen storage amount in the exhaust gas purifying catalyst 34 (the time $t_3$). Consequently, according to this embodiment, the above-described problems caused when the adjustment of the oxygen storage amount in the EGR catalyst 38 is not completed at the time of completion of the adjustment of the oxygen storage amount in the exhaust gas purifying catalyst 34 can be more reliably avoided.

In the above-described second embodiment, the ECU 50 controls the fuel injection amount in each cylinder by the above-described method between the time $t_1$ and time $t_2$ as shown in FIG. 3, thereby realizing the "air-fuel ratio control means" according to the first, second, and third aspects of the present invention. Also, the ECU 50 controls the air-fuel ratio in the #1 cylinder and #4 cylinder to be the theoretical air-fuel ratio and controls the air-fuel ratio in the #2 cylinder and #3 cylinder to be richer than the theoretical air-fuel ratio between the time $t_2$ and time $t_3$ as shown in FIG. 3, thereby realizing the "second air-fuel ratio control means" according to the fourth aspect of the present invention.

Third Embodiment

Next, a third embodiment according to the present invention will be described referring to FIG. 4. The difference from the above-described first and second embodiments will be mainly described, and the description of similar features will be simplified or omitted.

In the above-described first and second embodiments, EGR is executed immediately after return from the fuel cut. However, EGR may not be executed immediately after return from the fuel cut and EGR may be started in the middle of rich control. For example, EGR is started in the middle of the rich control when an engine is in an EGR operation prohibit region just after return from the fuel cut and then moved in an EGR operation permission region because a required engine load is increased.

In this embodiment, even when EGR is started in the middle of the rich control, the adjustment of the oxygen storage amount in the EGR catalyst 38 is controlled to be completed before the adjustment of the oxygen storage amount in the exhaust gas purifying catalyst 34 is completed.

Figure 4:
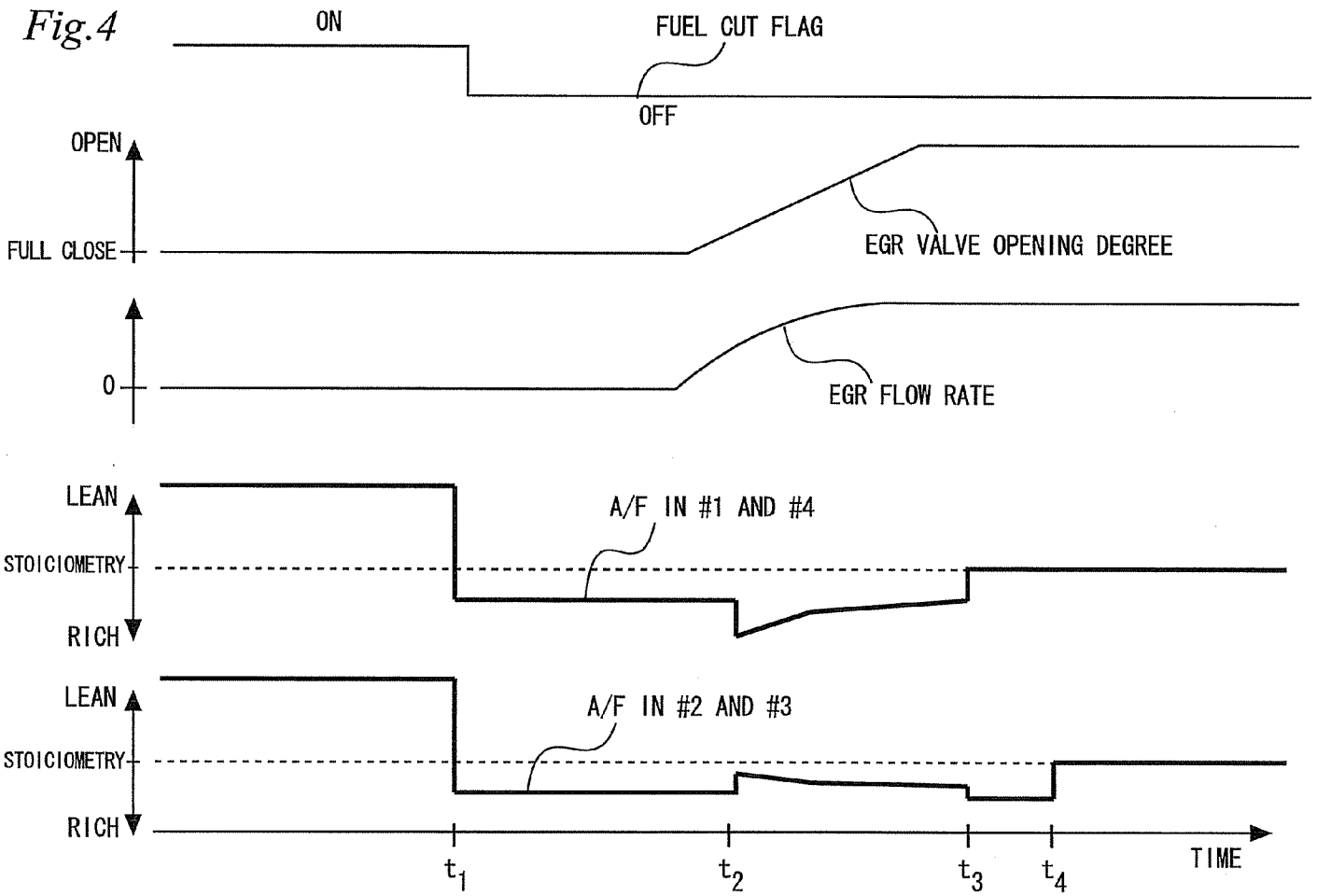
FIG. 4 is a time chart showing the change of an air-fuel ratio in #1 cylinder and #4 cylinder, the change of an air-fuel ratio in #2 cylinder and #3 cylinder, the change of an EGR valve opening degree, and the change of an EGR flow rate after return from the fuel cut according to Third Embodiment of the present invention.

FIG. 4 is a time chart showing the change of an air-fuel ratio in the #1 cylinder and #4 cylinder, the change of an air-fuel ratio in the #2 cylinder and #3 cylinder, the change of the EGR valve opening degree, and the change of the EGR flow rate after return from the fuel cut.

In the instance as shown in FIG. 4, at the time $t_1$, the fuel injection is restarted after return from the fuel cut and the rich control is immediately started, but EGR is not started. In the instance as shown in FIG. 4, EGR is substantially started at the time $t_2$. Until EGR is substantially started, i.e. between the time $t_1$ and time $t_2$, the air-fuel ratio in the #1 cylinder and #4 cylinder is controlled to be equal to the air-fuel ratio in the #2 cylinder and #3 cylinder.

After EGR is substantially started at the time $t_2$, the rich amount $R_{\#1\#4}$ in the #1 cylinder and #4 cylinder and the rich amount $R_{\#2\#3}$ in the #2 cylinder and #3 cylinder are calculated by the following expressions, respectively. Here, the $R_{EXH}$ is a value calculated by subtracting an amount corresponding to an amount of reducing agent supplied to the exhaust gas purifying catalyst 34 until EGR is substantially started (between the time $t_1$ and time $t_2$) from the target total rich amount $R_{EXH}$ in the exhaust gas purifying catalyst 34. Also, the relationship $N_1<N_2$ is satisfied.

$$R_{\#1\#4}=R_{EGR}/\alpha/N_1 \tag{5}$$

$$R_{\#2\#3}=R_{EXH}/N_2-R_{\#1\#2}(1-\alpha) \tag{6}$$

In the #1 cylinder and #4 cylinder, a value calculated by adding to a basic fuel injection amount a fuel amount corresponding to a half of the rich amount $R_{\#1\#4}$ calculated by the above expression (5) is a total fuel injection amount. After the time $t_2$ in FIG. 4, the total fuel injection amount is injected from the fuel injector 42. When an operation cycle number of the engine 10 after the time $t_2$ is reached to $N_1$ (at the time $t_3$ in FIG. 4), a total amount of the reducing agent delivered to the EGR catalyst 38 is reached to an amount corresponding to the $R_{EGR}$. Thus at this point, it can be determined that the adjustment of the oxygen storage amount in the EGR catalyst 38 is completed. After this point (the time $t_3$ in FIG. 4), the relationship $R_{\#1\#4}=0$ is set. Therefore, the air-fuel ratio in the #1 cylinder and #4 cylinder is returned to the theoretical air-fuel ratio after the time $t_3$ as shown in FIG. 4. Then, the exhaust gas having the theoretical air-fuel ratio is delivered to the EGR catalyst 38, so that the oxygen storage amount in the EGR catalyst 38 is maintained to be a half of the maximum oxygen storage amount.

Note that the EGR flow rate is low and the EGR rate a is also low just after EGR is started (just after the time $t_2$). Accordingly, the calculated rich amount $R_{\#1\#4}$ value becomes large. Thus, the air-fuel ratio in the #1 cylinder and #4 cylinder is shifted in such a direction as to be richer at the time $t_2$ as shown in FIG. 4. Subsequently, with the increase of the EGR flow rate, the air-fuel ratio in the #1 cylinder and #4 cylinder is gradually changed in such a direction as to be close to the theoretical air-fuel ratio.

On the other hand, in the #2 cylinder and #3 cylinder, a value calculated by adding to a basic fuel injection amount a fuel amount corresponding to a half of the rich amount $R_{\#2\#3}$ calculated by the above expression (6) is a total fuel injection amount. After the time $t_2$ shown in FIG. 4, the total fuel injection amount is injected from the fuel injector 42. When the operation cycle number of the engine 10 after the time $t_2$ is reached to $N_2$ (at the time $t_4$ in FIG. 4), a total amount of reducing agent delivered to the exhaust gas purifying catalyst 34 is reached to $R_{EXH}$. Thus at this point, it can be determined that the adjustment of the oxygen storage amount in the exhaust gas purifying catalyst 34 is completed. After this point (the time $t_4$ in FIG. 4), the relationship $R_{\#2\#3}=0$ is set. Therefore, the air-fuel ratio in the #2 cylinder and #3 cylinder is returned to the theoretical air-fuel ratio after the time $t_4$ in FIG. 4. Then, exhaust gas having the theoretical air-fuel ratio is delivered to the exhaust gas purifying catalyst 34, so that the oxygen storage amount in the exhaust gas purifying catalyst 34 is maintained to be a half of the maximum oxygen storage amount.

Note that when the air-fuel ratio in the #1 cylinder and #4 cylinder is shifted in such a direction as to be richer at the time $t_2$, a required rich amount in the #2 cylinder and #3 cylinder is decreased by the shift amount. Accordingly, the air-fuel ratio in the #2 cylinder and #3 cylinder is shifted in such a direction as to be close to the theoretical air-fuel ratio at the time $t_2$.

In addition, the relationship $R_{\#1\#4}=0$ is set between the time $t_3$ and time $t_4$ and therefore the rich amount $R_{\#2\#3}$ value calculated by the above expression (6) becomes large as compared to a period between the time $t_2$ and time $t_3$. Thus, as shown in FIG. 4, the air-fuel ratio in the #2 cylinder and #3 cylinder is shifted in a rich direction at the time $t_3$.

With the above-described control, the air-fuel ratio in the #1 cylinder and #4 cylinder is richer than the air-fuel ratio in the #2 cylinder and #3 cylinder between the time $t_2$ and time $t_3$ in this embodiment.

In the third embodiment as described above, even when EGR is started in the middle of the rich control, the adjustment of the oxygen storage amount in the EGR catalyst 38 can be completed at the time (the time $t_3$) before the adjustment of the oxygen storage amount in the exhaust gas purifying catalyst 34 is completed (the time $t_4$). Thus, the above-described problems caused when the adjustment of the oxygen storage amount in the EGR catalyst 38 is not completed at the time of completion of the adjustment of the oxygen storage amount in the exhaust gas purifying catalyst 34 can be further reliably avoided.

In the above-described third embodiment, the ECU 50 controls the fuel injection amount in each cylinder by the above-described method between the time $t_2$ and time $t_3$ as shown in FIG. 4, thereby realizing the "air fuel control means" according to the first, second, and third aspects of the present invention. Also, the ECU 50 controls the air-fuel ratio in the #1 cylinder and #4 cylinder to be the theoretical air-fuel ratio and controls the air-fuel ratio in the #2 cylinder and #3 cylinder to be richer than the theoretical air-fuel ratio between the time $t_3$ and time $t_4$ as shown in FIG. 4, thereby realizing the "second air-fuel ratio control means" according to the fourth aspect of the present invention.

REFERENCE SIGNS LIST

10 engine
12 intake path
16 intake manifold
20 intake branch pipe
26 exhaust path
32 exhaust path
34 exhaust gas purifying catalyst
36 EGR path
38 EGR catalyst
40 EGR valve
42 fuel injector
50 ECU

The invention claimed is:

1. A control apparatus for an internal combustion engine comprising:

an internal combustion engine including at least one recirculating gas generating cylinder capable of recirculating a part of its exhaust gas to an intake system and at least one recirculating gas nongenerating cylinder that does not recirculate its exhaust gas to the intake system;

an exhaust gas recirculating path having one end connected to an exhaust path through which exhaust gas only from the recirculating gas generating cylinder flows and having the other end connected to the intake system;

an exhaust catalyst for purifying exhaust gas provided on an exhaust path through which exhaust gas from the recirculating gas generating cylinder and the recirculating gas nongenerating cylinder flows;

a recirculating catalyst provided on the exhaust gas recirculating path for purifying exhaust gas that recirculates to the intake system;

fuel cut means that executes fuel cut for temporarily stopping fuel injection of the internal combustion engine; and rich control means that performs rich control for controlling an air-fuel ratio of the internal combustion engine to be temporarily richer than a theoretical air-fuel ratio when the fuel injection is restarted after return from the fuel cut, wherein the rich control means includes air-fuel ratio control means that controls an air-fuel ratio in the recirculating gas generating cylinder to be richer than an air-fuel ratio in the recirculating gas nongenerating cylinder when the rich control and an exhaust gas recirculation by the exhaust gas recirculating path are simultaneously performed.

2. The control apparatus for an internal combustion engine according to claim 1, wherein the air-fuel ratio control means controls the air-fuel ratio in the recirculating gas generating cylinder to be richer when an exhaust gas recirculation rate is low as compared to when the exhaust gas recirculation rate is high.

3. The control apparatus for an internal combustion engine according to claim 1, wherein the air-fuel ratio control means controls the air-fuel ratio in each of the recirculating gas generating cylinder and the recirculating gas nongenerating cylinder so that an adjustment of an oxygen storage amount in the recirculating catalyst is completed simultaneously with or before completion of an adjustment of an oxygen storage amount in the exhaust catalyst.

4. The control apparatus for an internal combustion engine according to claim 1 further comprising:

second air-fuel ratio control means that controls the air-fuel ratio in the recirculating gas generating cylinder to be the theoretical air-fuel ratio and controls the air-fuel ratio in the recirculating gas nongenerating cylinder to be richer than the theoretical air-fuel ratio when the adjustment of the oxygen storage amount in the recirculating catalyst is completed before the adjustment of the oxygen storage amount in the exhaust catalyst is completed.

5. A control apparatus for an internal combustion engine comprising:

an internal combustion engine including at least one recirculating gas generating cylinder capable of recirculating a part of its exhaust gas to an intake system and at least one recirculating gas nongenerating cylinder that does not recirculate its exhaust gas to the intake system;

an exhaust gas recirculating path having one end connected to an exhaust path through which exhaust gas only from the recirculating gas generating cylinder flows and having the other end connected to the intake system;

an exhaust catalyst for purifying exhaust gas provided on an exhaust path through which exhaust gas from the recirculating gas generating cylinder and the recirculating gas nongenerating cylinder flows;

a recirculating catalyst provided on the exhaust gas recirculating path for purifying exhaust gas that recirculates to the intake system;

a fuel cut device that executes fuel cut for temporarily stopping fuel injection of the internal combustion engine; and a rich control device that performs rich control for controlling an air-fuel ratio of the internal combustion engine to be temporarily richer than a theoretical air-fuel ratio when the fuel injection is restarted after return from the fuel cut, wherein the rich control device includes air-fuel ratio control device that controls an air-fuel ratio in the recirculating gas generating cylinder to be richer than an air-fuel ratio in the recirculating gas nongenerating cylinder when the rich control and an exhaust gas recirculation by the exhaust gas recirculating path are simultaneously performed.

* * * * *